US006014077A

United States Patent [19]

Beaumont et al.

[11] Patent Number: 6,014,077

[45] Date of Patent: Jan. 11, 2000

[54] ENTRY ALERT GUARD

[76] Inventors: Paul L. Beaumont; Mary A. Hannah-Beaumont, both of 4182 W. Orchid La., Chandler, Ariz. 85226

[21] Appl. No.: 08/902,219

[22] Filed: Jul. 29, 1997

[51] Int. Cl.[7] ..... G08B 13/08

[52] U.S. Cl. ..... 340/545; 340/686; 340/692

[58] Field of Search ..... 340/907, 908, 340/908.1, 692, 545, 546, 564, 686, 547

[56] References Cited

U.S. PATENT DOCUMENTS

| | | | |
|---|---|---|---|
| Re. 35,268 | 6/1996 | Frolov et al. | 340/545 |
| 3,820,102 | 6/1974 | Schubert | 340/545 |
| 4,278,968 | 7/1981 | Arnett | 340/545 |
| 4,835,520 | 5/1989 | Aiello | 340/545 |
| 4,982,176 | 1/1991 | Schwarz | 340/567 |
| 5,243,325 | 9/1993 | Marin | 340/545 |
| 5,473,310 | 12/1995 | Ko | 340/547 |

*Primary Examiner*—Donnie L. Crosland
*Attorney, Agent, or Firm*—Michael L. White, P.C.

[57] ABSTRACT

An apparatus for monitoring the positional status of a moveable gate in an entryway and capable of providing a warning when that status is altered with a programmable audio voice message.

9 Claims, 16 Drawing Sheets

ENTRY ALERT GUARD

BACKGROUND OF THE INVENTION

1. Field of the Invention

This invention relates to an Entry Alert Guard that provides an audible message whenever an entryway is opened or left unsecured.

2. Description of the Related Art

Swimming pool gate alarms have the potential for saving the lives of hundreds of children who die every year because of accidental drowning. Many of these drownings occur when children gain entrance to pool areas through unsecured pool gates. These drownings could be averted if an effective warning system were available to ensure the proper closure of swimming pool gates. The gate alarms currently available have several design deficiencies that prevent these alarms from being truly effective. The most significant of these deficiencies is the alarm system's reliance on their obnoxious noise level to signal an open entryway.

Intentional vandalism is a common occurrence and usually prevents pool gate alarms from effectively performing their life saving role. The gate alarm's noise tends to attract juveniles who frequently vandalize and render these alarms inoperable. In addition to juvenile vandalism, these units are often the target of adults who disable the unit merely to stop the intensely irritating noise that they produce.

This alarm noise problem also manifests itself in another operational problem. In an emergency, the alarm noise tends to create additional confusion. This confusion comes not just from the mental stress created by the intense noise, but also from the concurrent inability to communicate with others. Consequently, the alarm may actually hinder a favorable outcome to the situation.

Another problem with the current state of the art is that these alarms are often battery powered. Battery life is dependent on the usage of the device, the number of alarms, and even the weather conditions. Consequently, the battery will fail unexpectedly. Without back up power, the alarm is immediately disabled, and will remain so until maintenance detects the dead battery.

Instead of battery power, many industrial and commercial applications use alarms that require 120-volt AC power. These power sources may not be practical because of the remoteness of the installation to readily available power outlets. In addition, the high voltage levels required by such systems may present a safety hazard. In particular, these alarms present an unacceptable high safety risk when used around pool enclosures where the presence of water could produce an electrical shock hazard.

Ko (U.S. Pat. No. 5,473,310) presents the most significant example of prior art in swimming pool gate alarms. This patent discloses a pool guard alarm that uses a gate sensor, (including a magnetic sensor and a permanent magnet), a battery power source, a delay timer, and a reset button. Holding a gate open after a predetermined time delay will cause the alarm to sound. In addition, failing to push the reset button after entry will also cause the alarm to sound.

The Ko patent, however, has some severe shortcomings. First, the Ko patent relies on a battery that will drain and fail at some unpredictable time, defeating the alarm's safety purpose. Secondly, the alarm mechanism is located on the gate itself and is subject to tampering or vandalism that can defeat the device. Thirdly, the device only sounds an obnoxiously loud alarm. This often only instills within people a desire to disable the alarm. Fourth, the alarm does not identify why it is sounding. Fifth, the alarm does not provide instructions for the alarm's termination.

U.S. Pat. No. 4,278,968 (Arnett) discloses a prior art device that provides an audible alarm when a door is not properly closed. Using magnetic switches in conjunction with a time delay relay, an alarm automatically sounds if the door is left open for a period longer than the pre-set time delay. The circuit automatically resets itself once the entryway is closed. This device has severe design deficiencies when utilized as a swimming pool gate alarm. The alarm's use of a 120 V-power supply presents a safety hazard. Although the 120-volt supply power is transformed to a lower operating voltage, that portion of the circuit at the higher operating voltage still presents a safety hazard. A failure in the high voltage circuit could propagate and present a safety hazard on even the low voltage circuit. Because of current rectification, this prior art design requires more components of greater complexity. These additional components increase maintenance and reliability problems. Finally, the device when activated can only produce a blaring alarm, the shortcomings of which have already been noted above.

SUMMARY OF THE INVENTION

The present invention overcomes the disadvantages of the prior art described above. It is the objective of the present Entry Alert Guard to provide an effective and reliable system to detect entry into a secured area through a moveable entryway (e.g., gate, door, or any other moveable barrier). Failure to secure the entryway causes the system to emit a warning alert in the form of an audible voice message. The system may also provide the alert regardless of whether or not the entryway is re-secured. The invention's unexpected effectiveness is due to several novel and non-obvious design features that prevent child drowning.

All of the prior art gate alarms have relied on blaring alarms designed to force individuals into compliance. The alarm becomes such a nuisance and is so offensive that even those that understand its safety significance often intentionally disarm it. This significantly reduces the availability of the prior art systems. In some cases, although an individual may want to respond to the alarm, the desired response to the alarm may not be known. Consequently, the loudness of the alarm simply may cause the individual to leave the area without taking any corrective action. The present invention however, gently elicits the cooperation of bystanders to secure the entryway. The present invention corrects each of the prior art deficiencies discussed above.

The Entry Alert Guard's voice synthesizer capability is the key to the system's effectiveness. It can record customized messages providing instructions, warning, or any other information pertinent to an individual entering the area. The voice synthesizer circuit ensures that people understand not only the purpose of the alert, but also the proper response to the alert. The voice synthesizer is used to elicit the cooperation of people either entering the area, or of nearby bystanders. The opening of an entryway triggers the system to deliver the appropriate message. The message may be time delayed, or even omitted if the entryway is secured. After the entryway is closed, the system may make a verbal announcement to indicate that the entryway is secure.

The system can also provide an acknowledgement to the closure of the entryway. This acknowledgement can provide positive reinforcement to help ensure future compliance. For example, in the case of a pool gate, the system may announce "thank you for closing the gate". In the event the entryway is not properly secured, the system is capable of altering the message and message volume to more forcefully request the desired action. This capability to not only select from a series of messages, but also to select the volume at which the message is delivered, makes the present invention particularly effective. As bystanders learn that the message only escalates in volume, the natural response is to avert the additional messages by ensuring that the gate is closed.

The Entry Alert Guard's voice synthesizer appeals for action in a manner that most effectively elicits cooperation. Because of this feature, the Entry Alert Guard is unexpectedly successful in securing the closure of an entryway. The voice-synthesized messages make a psychological appeal on a number of different levels in order to prompt the desired action. The system accomplishes its objective by motivating people through reasoning and logic, education, group peer pressure, and emotional appeal.

In addition to being effective, the reliability of the present invention is a quantum improvement over the prior art systems. Several design features account for this reliability improvement. These design features improve system tamper resistance, increase system component reliability, or increase the reliability of the systems' power supply. The most significant of these tamper resistance features is the ability to mast mount the system electronics, solar panel, and speaker in an elevated position out of the reach of anyone attempting to disarm or vandalize the device.

Another significant tamper resistant features are the totally enclosed magnetic switches used to detect the entryway's positional status. These magnetic switches have no external moving parts. The absence of exposed, moving mechanical components increases the reliability of the system. Vandals can disable mechanical switches by bending or otherwise breaking their external components. The electrical signal from the magnetic sensors is routed to the system's electronics with insulated wiring enclosed in rigid electrical conduit.

The Entry Alert Guard's solar panel ensures that the system is always operable. A power outage will never disable the self-powered Entry Alert Guard. It also eliminates the possibility that vandals can severe the power supply wiring. An added benefit of the solar panel is that power supplied to the system is at current levels and voltages that do not present a safety hazard. The solar panel also allows the unit to be mounted in inaccessible areas where battery replacement would be difficult or where power is inaccessible.

Besides the objects and advantages of the present invention described above, several additional objects and advantages of the present invention are:

1. This gate alarm, unlike many other designs, has a number of multi-functional applications because of the programmability of the microcontroller and the voice synthesizer integrated circuit. The present invention can be used wherever doors and gates need to provide a warning or entry instructions.
2. The ability of the present invention to provide verbal instructions, rather then just a blaring alarm provides a significant advancement over previous gate or door alarms. These messages announce why the alarm was activated, and what the proper response is to deactivate the alarm. Thus, rather than creating more confusion, the alarm can be used to reduce confusion.
3. The Entry Alert Guard is extremely practical in areas that require relative quiet such as hospital, resorts, and residential surroundings.

Although the discussion above contains many specifics, these should not be construed as limiting the scope of the invention, but as merely providing illustrations of some presently preferred embodiments of this invention. Although a specific embodiment of this invention has been described, it is apparent that some minor changes of structure and operation could be made without departing from the spirit of the invention as defined by the scope of the appended claims. Still, further objects and advantages will become apparent from a consideration of the ensuing description and drawings.

DESCRIPTION OF THE PREFERRED EMBODIMENTS

Figure 1:
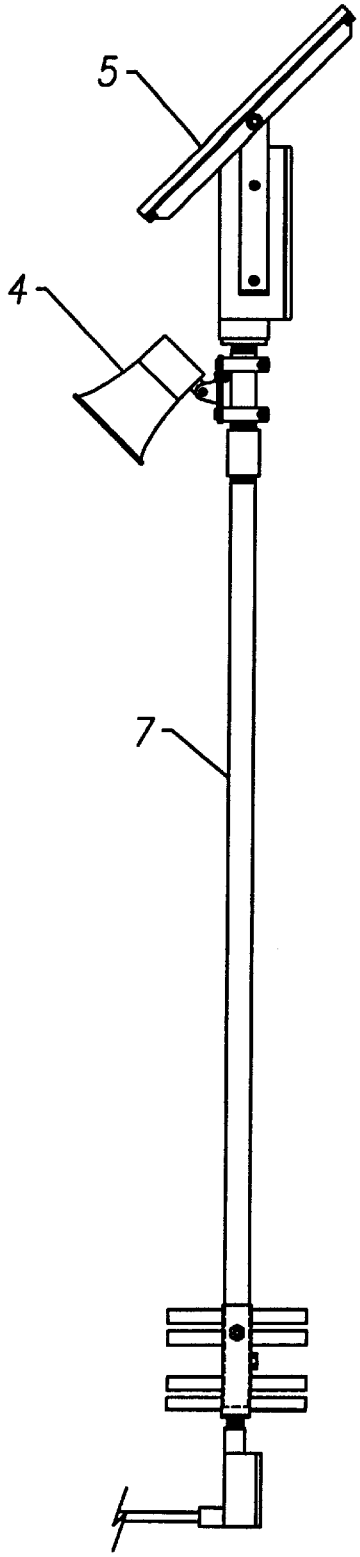
FIG. 1 is a side view of the Entry Alert Guard in its typically installed configuration.
Figure 2:
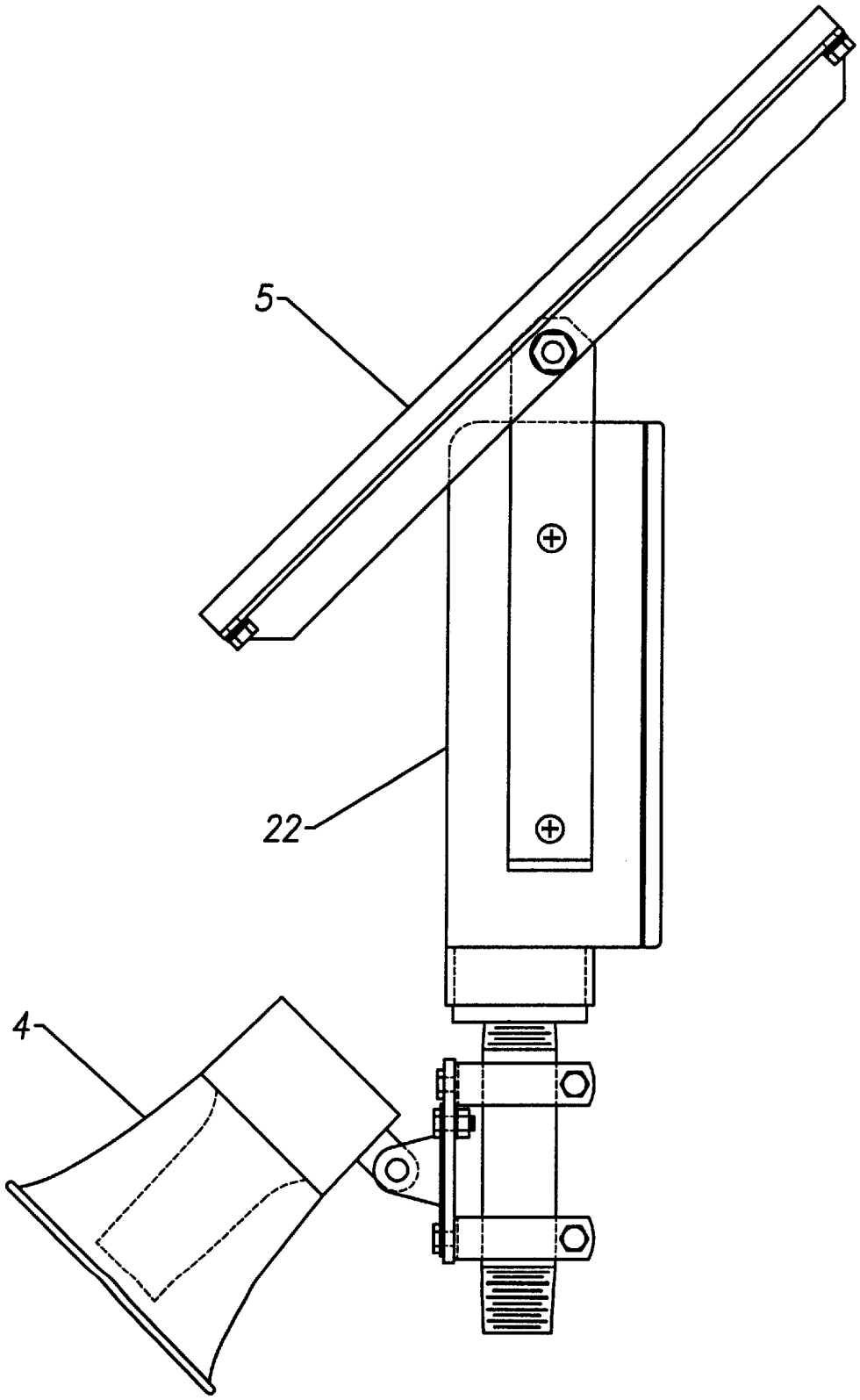
FIG. 2 is a side view of the Entry Alert Guard's electrical enclosure, speaker, and solar panel.
Figure 3:
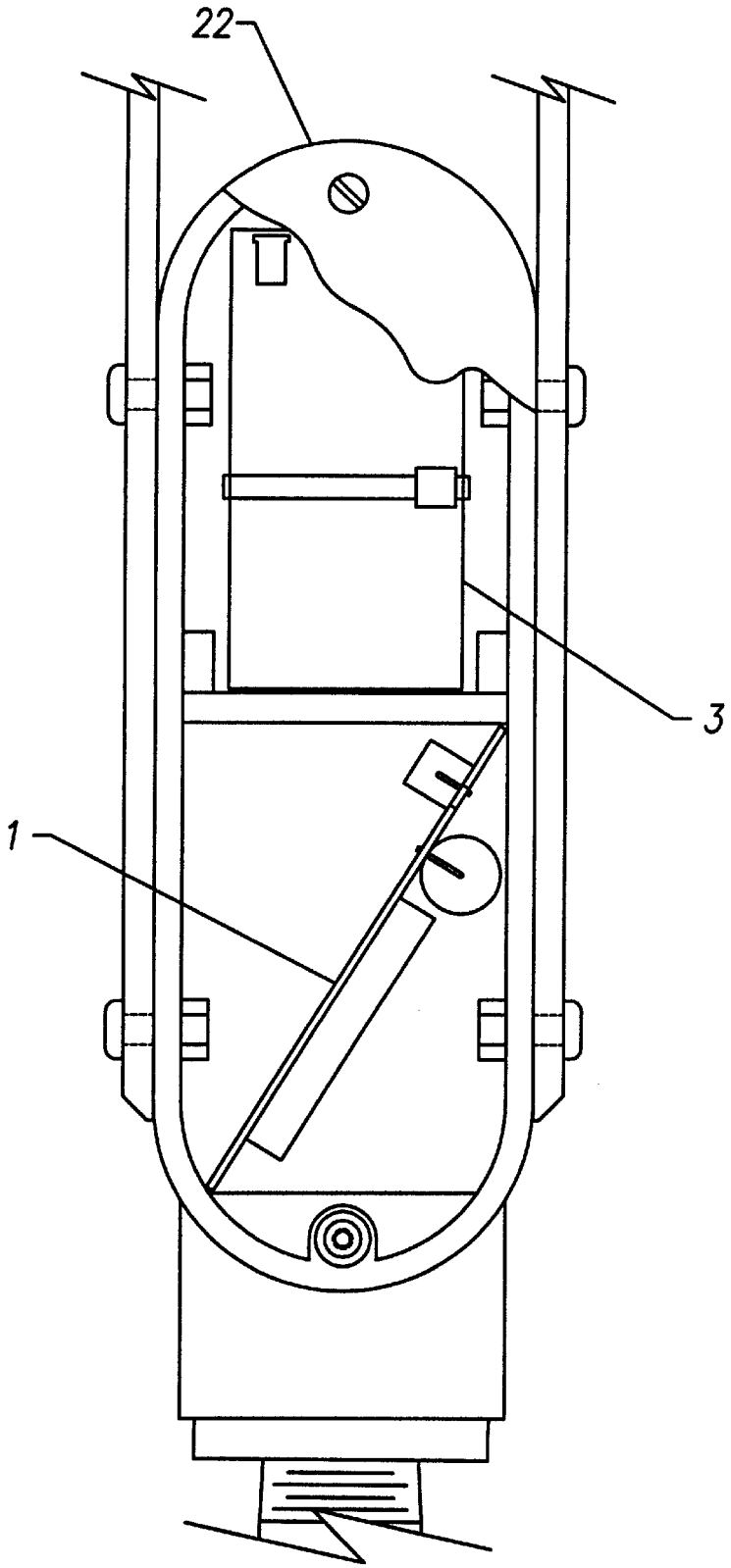
FIG. 3 is a rear cut away view of the Entry Alert Guard's electrical enclosure.
Figure 4A:
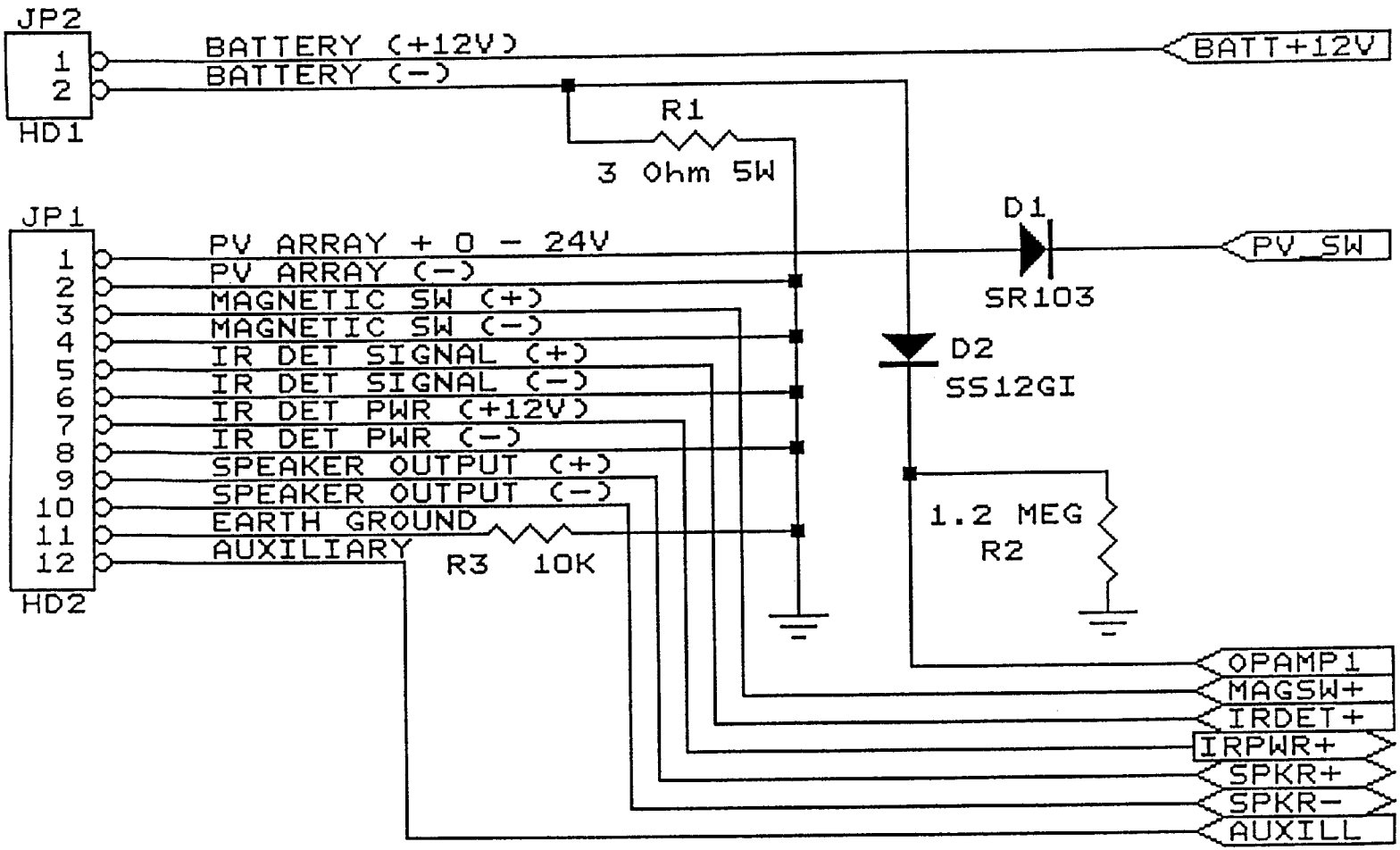
FIG. 4A, 4b, 4C, 4D, 4E, and 4F is a typical electrical schematic for the Entry Alert Guard.
Figure 4B:
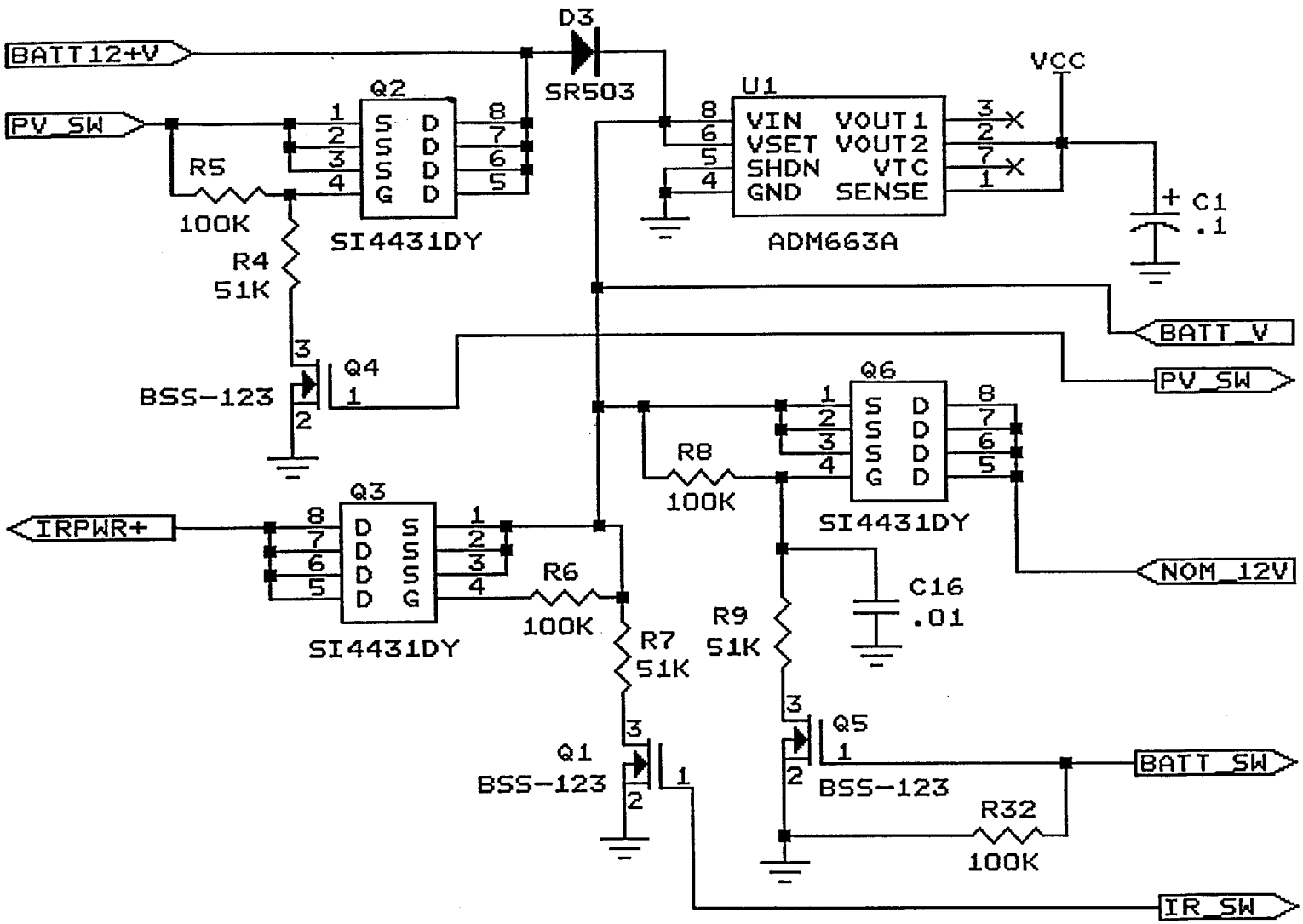
Figure 4C:
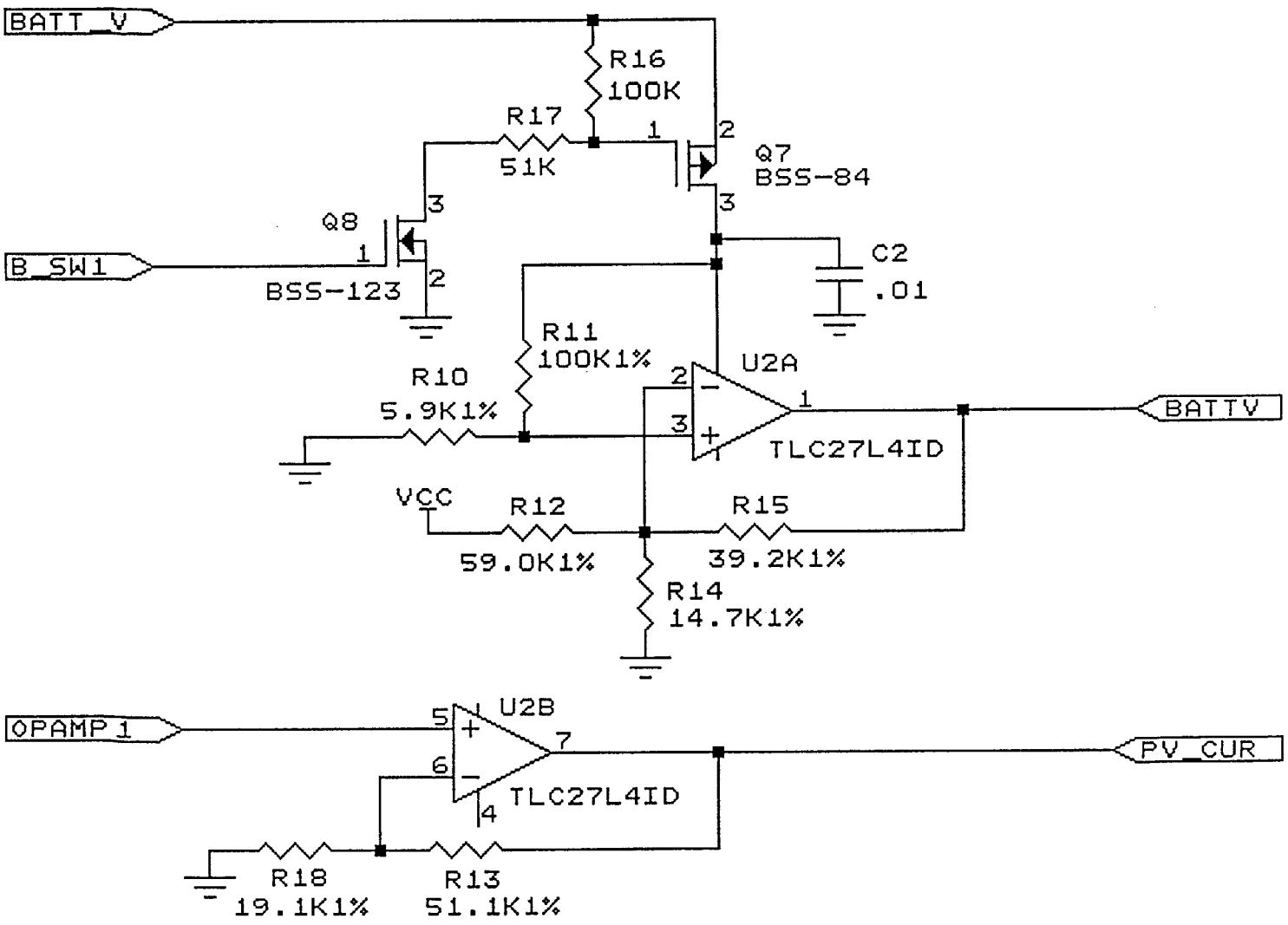
Figure 4D:
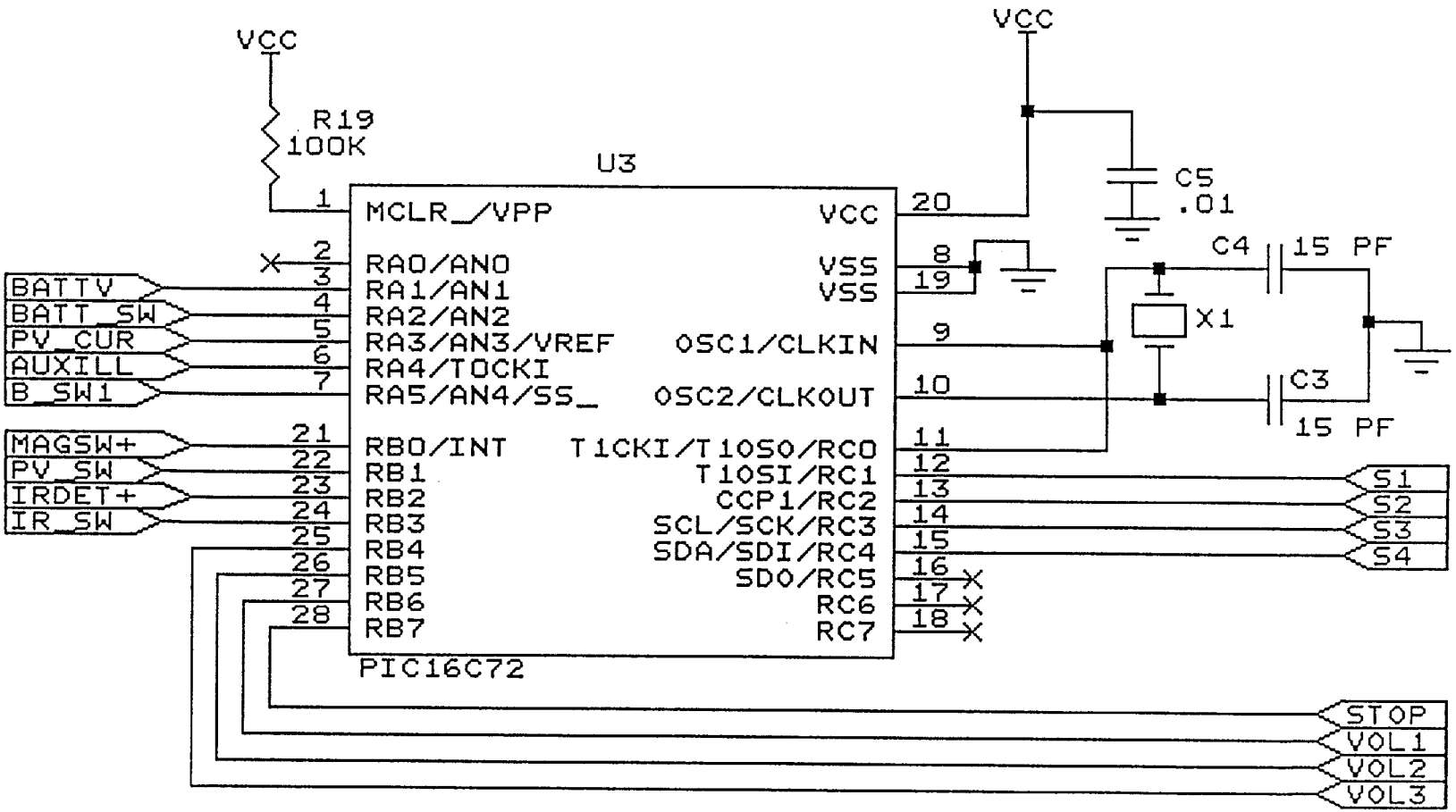
Figure 4E:
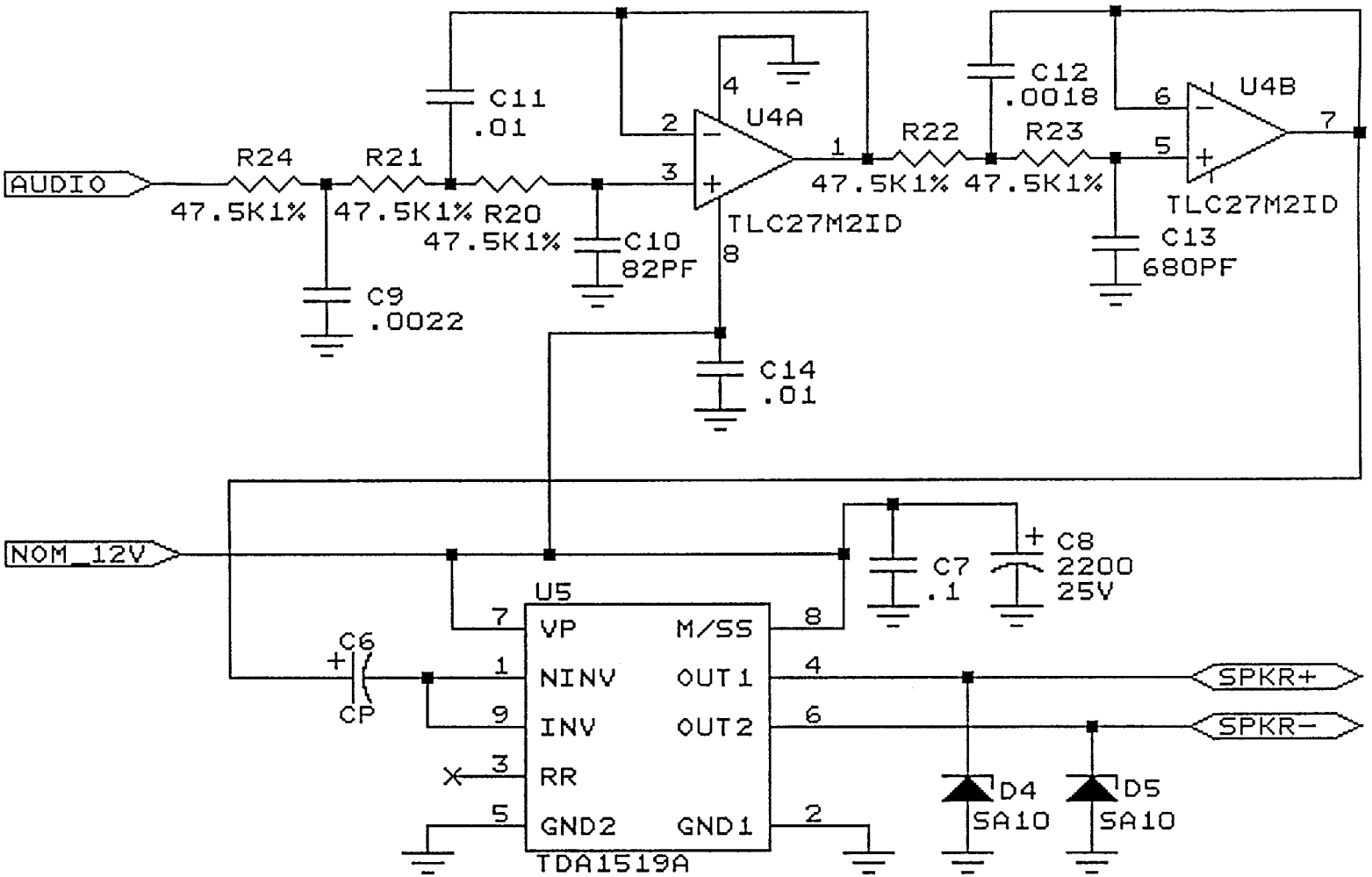
Figure 4F:
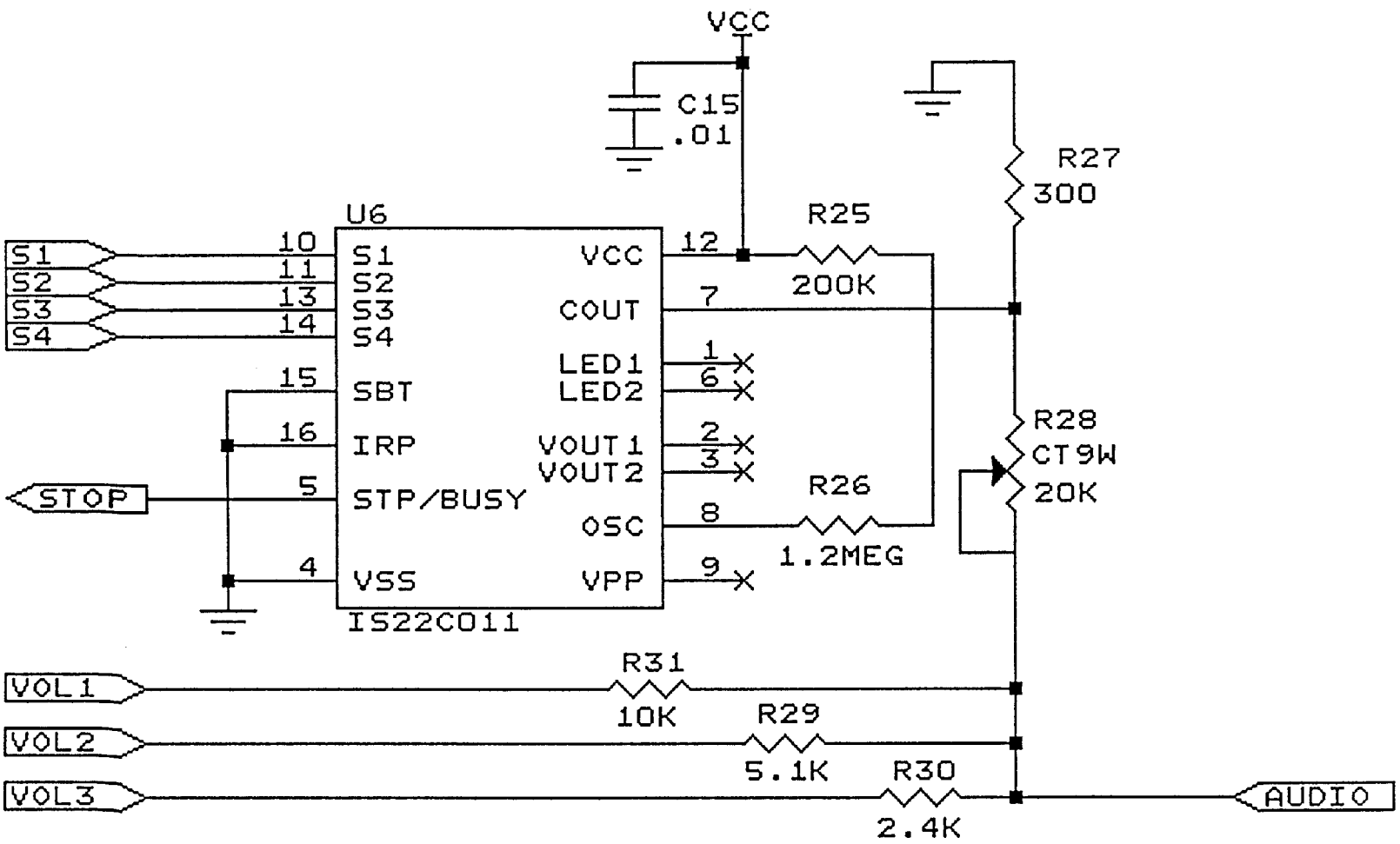

This invention advances the state of the art of gate alarms by providing a more effective and reliable means to ensure that a gate or door is closed, or to provide a message whenever a gate or door is opened. A preferred embodiment of the present invention is illustrated in FIG. 1.

Figure 5:
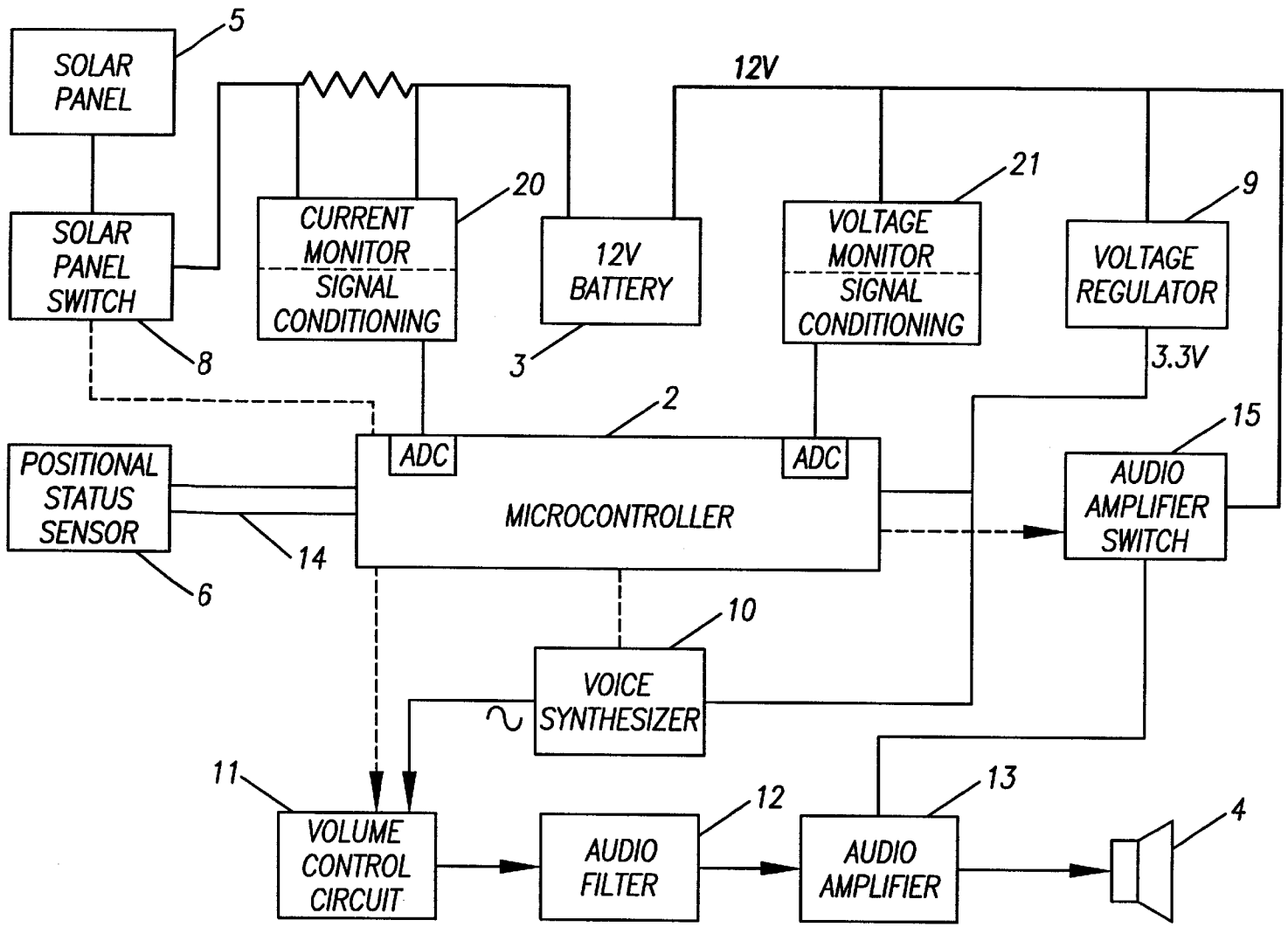
FIG. 5 is an electrical block diagram for the Entry Alert Guard

The core of the present invention is a printed wiring board (PWB) (1). The PWB contains the electronic components that control the Entry Alert Guard's response to the opening or closing of an entryway. The PWB also serves to control the charging and discharging of the Entry Alert Guard's rechargable power source (3) (e.g., a battery). The PWB is wired to a speaker (4) and to a positional status sensor (6). The PWB is house in an electrical enclosure 22. The electrical encloseure contains the rechargable power source (3) to power an audio amplifier and to power the PWB. The battery is recharged by a solar panel (5). The electrical enclosure, solar panel, and speaker may be mounted to a mast (7) to place the unit beyond the reach of vandals. FIG. 5 depicts an electrical block diagram describing the general interconnections for these electrical components.

Figure 6A:
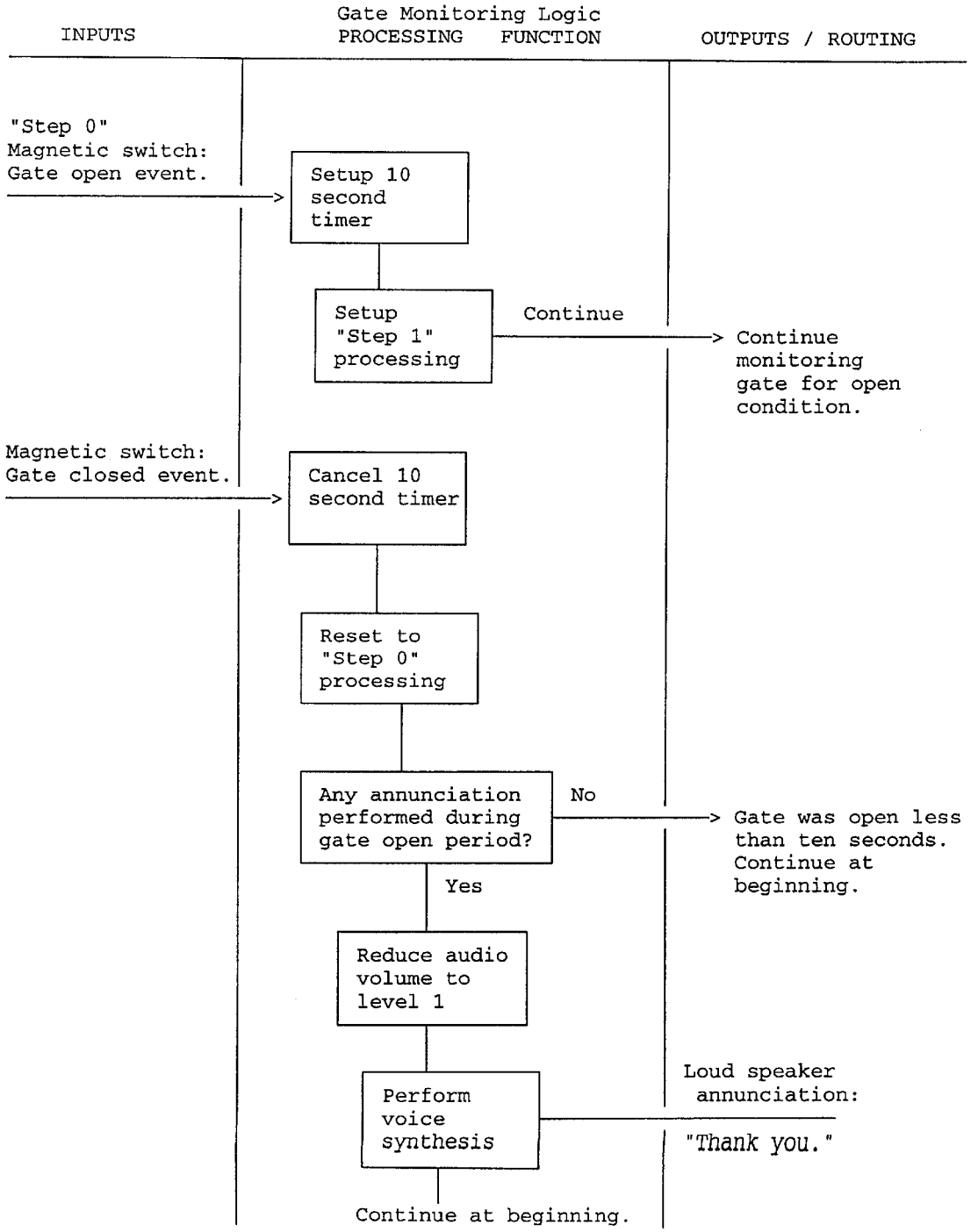
FIG. 6A is a flowchart of the microcontroller's firmware instructions for the Gate Monitoring Logic Functions for a gate closed event.
Figure 6B:
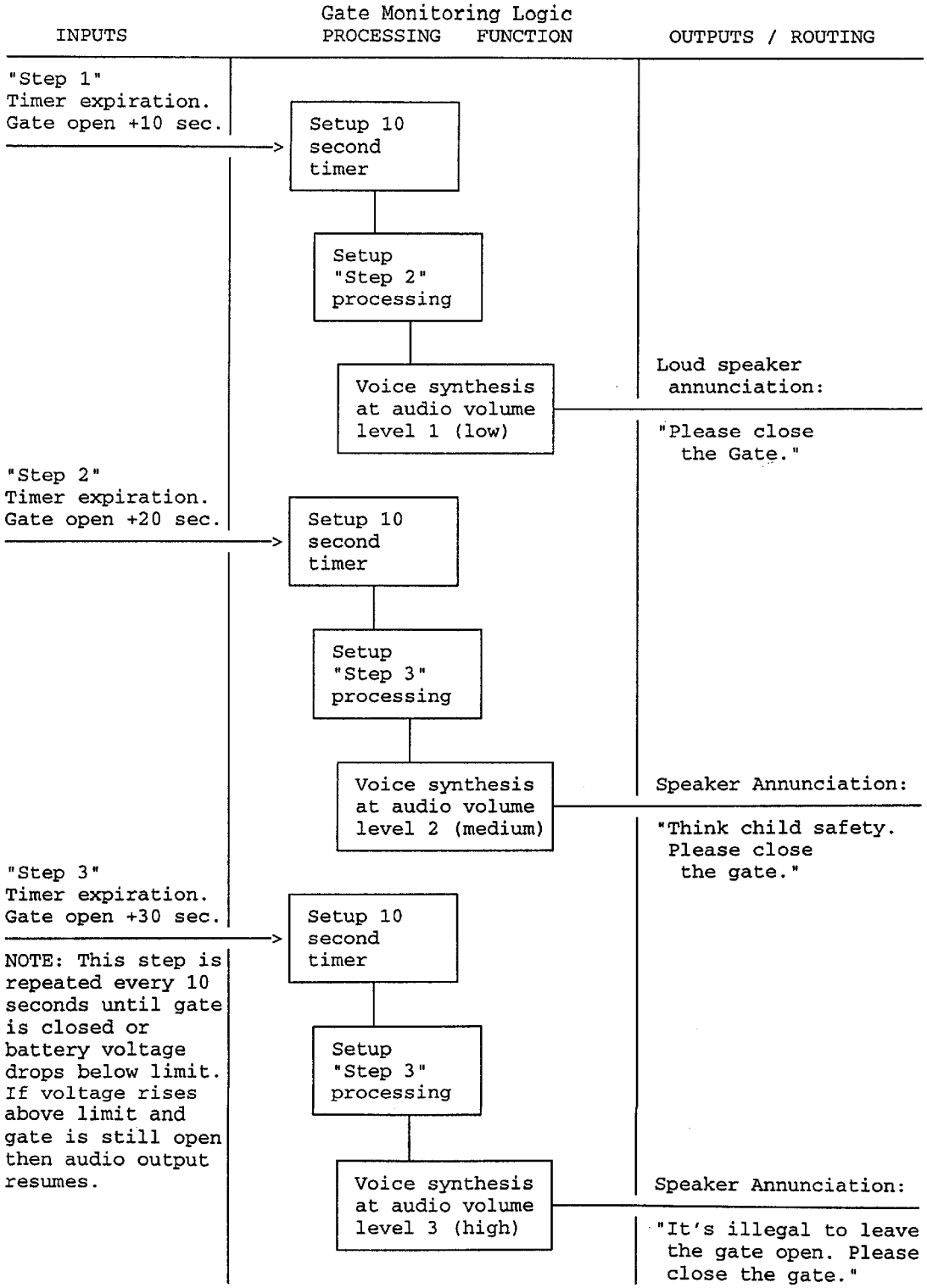
FIG. 6B is a flowchart of the microcontroller's firmware instructions for the Gate Monitoring Logic Functions for a gate open event.

The preferred embodiment of this invention uses a One Time Programmable (OTP) microcontroller (Microchip model PIC 16C72) for the Entry Alert Guard's control circuit. This microcontroller contains all of the Entry Alert Guard's firm ware that monitors and manages the system's response to a change in the positional status of the gate. The microcontroller determines whether to play a warning message, the content of the warning message, and the loudness of the message. The microcontroller has an analog-to-digital (ADC) capability, which allows it to convert incoming analog signals into digital format. The microcontroller's firmware logically processes these signals to manage the system. A flowchart of this firmware is shown in FIG. 6A and FIG. 6B. This flowchart describes how the microcontroller responds to the system inputs that it receives.

Figure 6C:
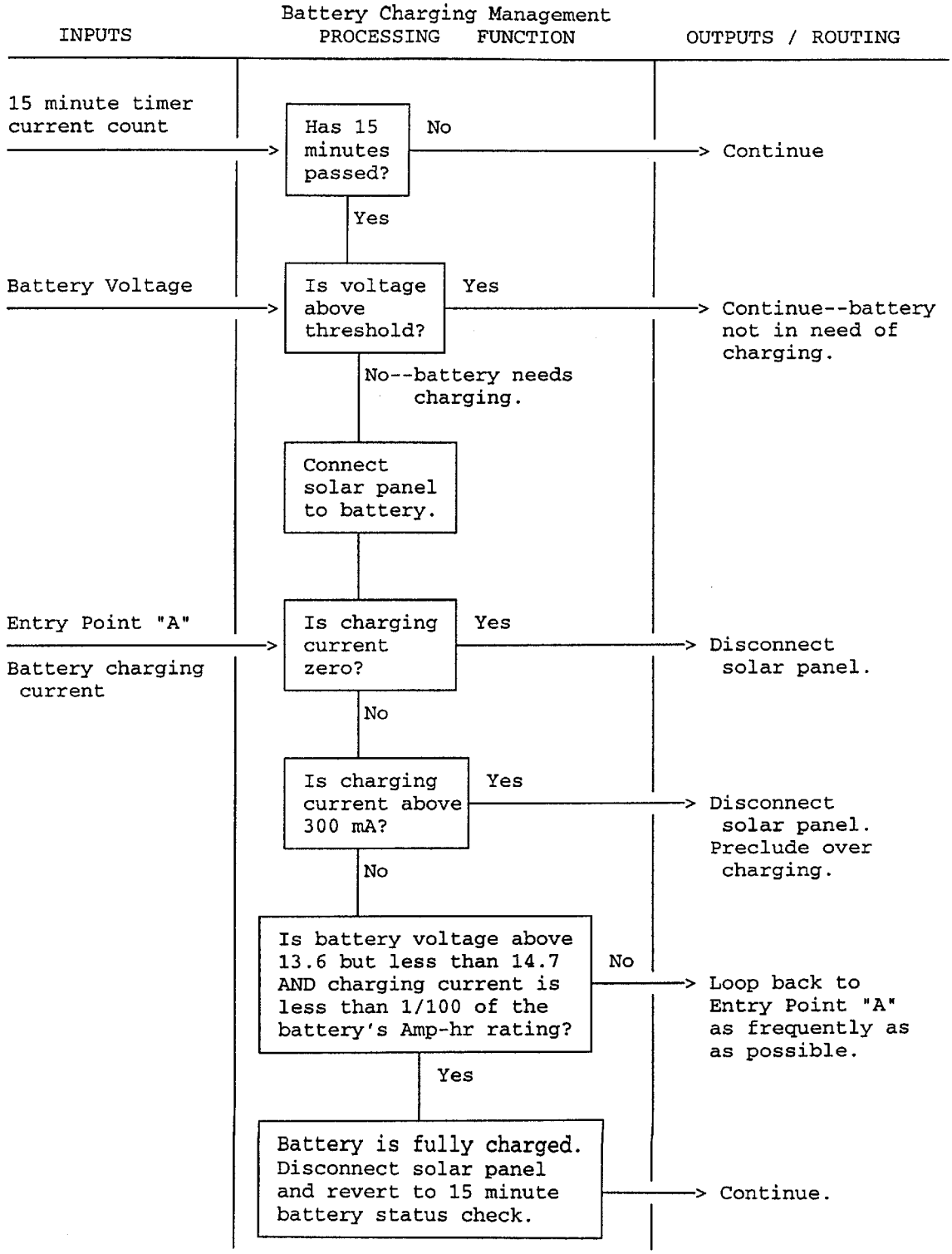
FIG. 6C is a flowchart of the microcontroller's firmware instructions for the Battery Charger Management Logic Functions.
Figure 7:
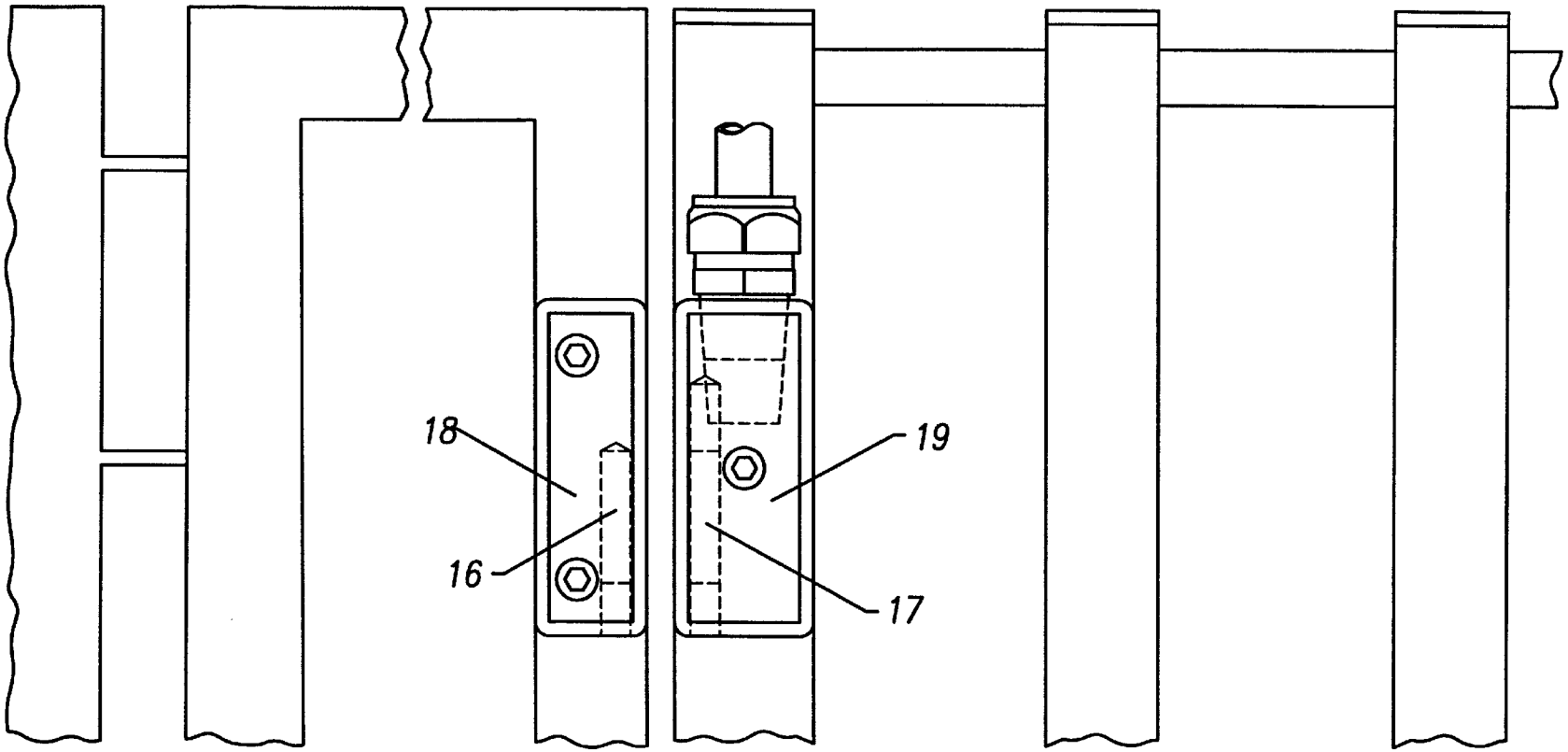
FIG. 7 is a sectional view of the Entry Alert Guard's proximity switch in its installed configuration on a gate.
Figure 8:
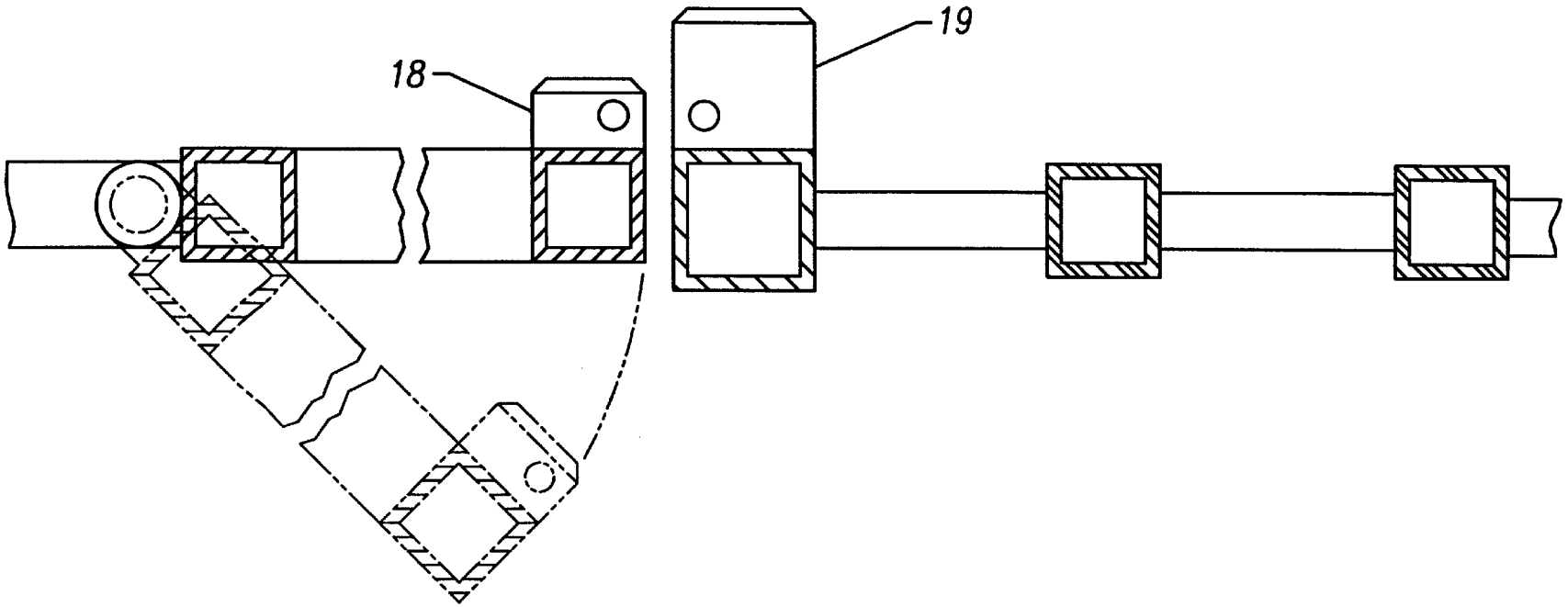
FIG. 8 is the typical proximity switch installation configuration.

The microcontroller also monitors and manages the charging and discharging of the system's battery. The PWB contains two electrical monitoring circuits. One circuit is a current monitor (20) that measures the solar panel charging current. The other circuit is a voltage monitor (21) that measures battery voltage. These electronic circuits are shown on FIGS. 4A, 4B, 4C, 4D, 4E and 4F. These electrical monitoring circuits condition the voltage and current signals to make them compatible with the microcontroller (2). FIG. 6C shows the logic process the microcontroller performs on these signals to determine if the battery is overcharging or is in an undercharged condition. The microcontroller controls charging by signaling the solar panel switch (8) to interrupt the flow of power from the solar panel (5) to the rechargable power source (3) if overcharging occurs. An undercharged battery will cause the microcontroller to close the solar panel switch if current is available from the solar panel (5). The preferred embodiment of the solar panel switch (8) is an electronic switch known as a Metal Oxide Field Effect Transistor (MOSFET).

The microcontroller (2) also has an internal timer, in addition to a series of time delays programmed into the microcontroller. These time delays are shown and functionally described in FIG. 6B which provides a flow chart of the microcontroller's gate monitoring logic functions as programmed into the microcontroller (2). An initial time delay of approximately 10 seconds is typically allotted for the closure of an entryway. Subsequent time delays space apart the announcement of further messages if the gate is not closed. The microprocessor matches each of these time delays to a specific alert signal stored in the microcontroller. When a time delay is exceeded, as determined by the internal timer, the microcontroller outputs the corresponding alert signal. The microcontroller also has a stand down signal stored in the microprocessor. The microprocessor outputs the stand-down signal whenever the microcontroller receives a closed signal, or alternately, only if the closed signal is received after a time delay.

The voice synthesizer (10) is a commercially available integrated circuit (Integrated Silicon Solutions model IS22C011) capable of storing several phrases. The microcontroller (2) can select any phrase or combination of phrases for the voice synthesizer integrated circuit to output. A volume control circuit (11) is provided on the PWB that is capable of controlling the volume level of the selected message.

A battery is the preferred power source for the present invention. The system can also use rectified AC current. The preferred battery embodiment is a sealed 12 Volt, 1.3 Ampere hour lead acid gel cell type battery. This battery provides a combination of long life and sufficient storage capacity to power the system overnight when solar panel recharging is not available. In addition, the lead acid gel cell has minimal outgassing which helps preclude contamination of the electrical components contained within the enclosure.

A step-down voltage regulator (9) reduces battery voltage to the PWB's operating voltage. The battery directly powers the audio amplifier (13). A second electronic switch, the audio amplifier switch (15) is connected between the battery and audio amplifier (13). The preferred embodiment for this switch is an MOSFET.

Obviously, a number of different types of positional status sensor (6) can detect gate position. The sensor need only open or close a circuit. In the preferred embodiment, a proximity switch that uses a magnetic sensor assembly is employed. The proximity switch is composed of two components. Attached to the gate is a magnet housing (18) with an internal magnet (16). Attached to the entryway frame is a switch housing (19) with a switch (17) located within the housing. The housings enclosing the proximity switch components are totally enclosed and consequently, tamper resistant.

Proximity switches that use magnetic sensors have two distinct advantages. Magnetic sensors do not require any physical contact between the mating sensors, or between the gate and frame that the sensors monitor. In addition, magnetic sensors are totally enclosed and self contained. Consequently, magnetic sensors are difficult to vandalize. Mechanical sensors that open and break electrical contacts could be utilized in the present invention. However, these types of sensors are more complex and less reliable. Their external moving parts require precise alignment and are easily vandalized. Hence, magnetic sensors are preferred. The positional status sensor is electrically connected to the microcontroller to provide a sensor loop that delivers an open or a closed sensor loop signal indicating whether the gate is open or closed.

Figure 9:
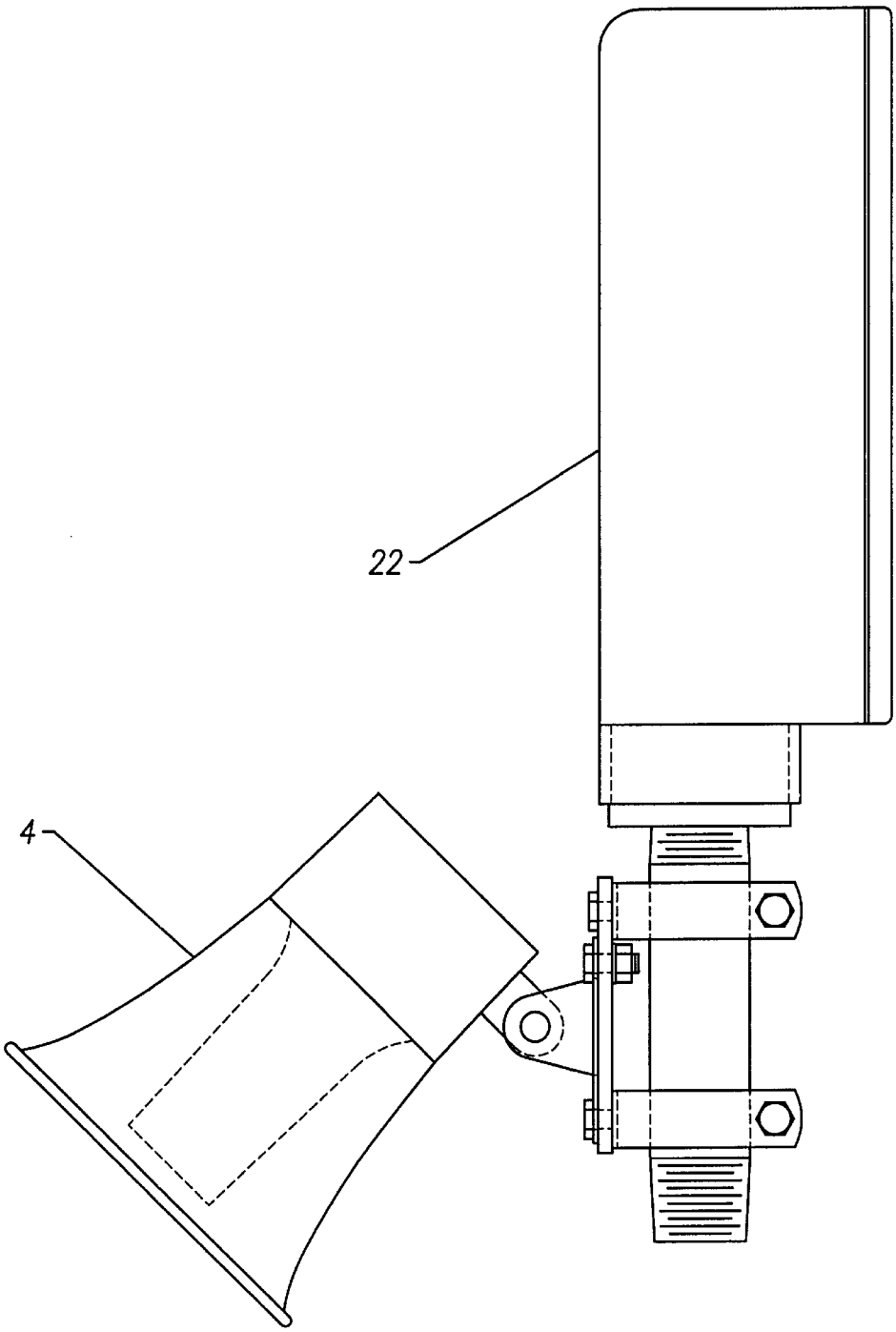
FIG. 9 is a side view of an alternate embodiment of the present invention without solar panel battery recharging.

In addition to the preferred embodiment shown in FIG. 1, an alternate embodiment can be created by powering the unit solely from battery power without the benefit of a solar panel (5) as shown in FIG. 9. Although this increases the required maintenance of the system, it also allows indoor applications of the system.

OPERATIONAL DESCRIPTION

The following operational description is the preferred embodiment for the Entry Alert Guard which uses a solar panel (5) to recharge a battery that powers the system.

The system is activated whenever a positional status sensor (6) detects that a moveable barrier, such as a gate, in an entryway is being opened. A magnet (16) on the moveable barrier maintains the electrical contacts of the sensor in a normally open position. The opening of the moveable barrier closes the switch contacts. This causes the sensor loop (14) connected to the microcontroller (2) to change state, from the open circuit voltage to a nominal zero volts when the positional sensor contacts close. The microcontroller (2) detects this change in the sensor loop line voltage and causes it to execute the gate open event portion of its program (i.e., open signal received) as describe in FIG. 6B.

The microcontroller's internal timer starts to measure elapsed time as soon as the open signal is received from the sensor loop (14). If the entryway is closed, the magnet (16) opens the electrical contacts of the positional status sensor (6). This causes the sensor loop line voltage to return to its normal voltage. The microcontroller detects this change to normal line voltage through the sensor loop. The microcontroller then implements the firmware instructions described and shown on FIG. 6A for the gate-closed event. If the internal timer's elapsed time is less than the initial time delay, the microcontroller cancels the "entry alert" portion of the microcontroller program and returns to normal sensor loop monitoring. The microcontroller can also positively reinforce the gate closure with a "thank you" message. For example, the microcontroller might select and deliver the message "Thank you for protecting children around water."

If the gate remains open however, the microcontroller, once it determines that the internal timer has exceeded the set time delay, will select a message and a volume level at which the selected message will be announced. The message selected is dependent on the alert signal the microcontroller outputs to the voice synthesizer (10). The voice synthesizer (10) then matches the alert signal to the corresponding message signal stored in the voice synthesizer. The message signal is then output to the volume control circuit (11). The microcontroller (2) determines the desired volume level of the audible message. The microcontroller (2) signals the volume control circuit (11) to condition the message signal input received from the voice synthesizer to that equivalent volume level. The volume control circuit (11) then outputs an elevated message signal.

The sound quality of the audible message announced from the speaker is improved by filtering the noise from the elevated message signal. The elevated message signal is signal processed through an audio filter (12) to improve sound quality. The result is a filtered message signal output from the audio filter (12). The audio amplifier (13) then amplifies the filtered message signal. The amplifier (13) outputs an amplified message signal. The speaker (4) receives the amplified message signal. The speaker (4) then outputs an audible message. FIG. 6B shows and describes the programming for the gate-open event. In this case, the voice synthesizer is programmed to play the message "Please, close the gate!" at the lowest volume level.

If the gate remains open, and the internal timer exceeds a second set time delay, the microcontroller causes the announcement of the same or another message at the same or higher volume level. For example, a second message "Think child safety. Please close the gate!" could be delivered at a higher volume level.

If the gate remains open past a third set time delay, still another and stronger message may be played. For example, the message "It is illegal to leave the gate open. Please close the gate!" This message may be played at the highest volume level to elicit cooperation. This message can be repeatedly played at set timed intervals until the gate is closed.

If the gate is never closed, the battery power used to play the messages could be depleted and the battery damaged. To prevent battery damage, the microcontroller can be programmed to suspend any further message announcements whenever the battery voltage is reduced to a predetermined level. Although this temporarily disables the unit, it preserves the unit's ability to function when sufficient solar power does become available. When battery voltage increases to a safe level, message annunciation will resume if the gate is still open. This program preserves the operability of the unit for a later time when people may be available to close the gate. Alternately, the microcontroller may be programmed to allow the warning messages to be played until the battery is dead. FIG. 6C shows the firmware that controls the battery charging management logic functions.

To prevent excessive power consumption, the audio amplifier switch (15) can disconnect the battery power supply to the audio amplifier (13). The microcontroller (2) signals the audio amplifier switch (15) to allow current flow during message delivery. At all other times the microcontroller directs this switch to the open position.

During a non-charging period, the microcontroller (2) evaluates the battery voltage at periodic intervals. The voltage monitor (21) determines battery voltage and conditions the resultant signal for input to the microcontroller (2). If battery voltage is below a predetermined level, the microcontroller signals the solar panel switch (8) to connect the solar panel (5) to the battery (3) for recharging. The microcontroller then evaluates the charging current generated by the solar panel. The current monitor (20) measures the charging current from the solar panel (5) and conditions the resultant signal for input to the microcontroller (2). If the charging current is zero, then the microcontroller signals the solar panel switch (8) to disconnect the solar panel from the battery. This process is repeated until the microcontroller detects a positive charging current. The detection of a positive charging current begins the battery charging cycle. The solar panel continues the charging cycle until either 1) there is insufficient light to support charging, 2) the battery becomes fully charged, or 3) the charging rate is too high. If any of these conditions exist, the microcontroller (2) signals the solar panel switch (8) to disconnect the solar panel.

The battery is fully charged when the charging current rate is minimal (for a lead acid gel cell battery this is approximately 1/100 of the Ampere-hour rating of the battery) and the charging voltage is between 13.8 and 14.8 volts. The charging rate is generally too high when the charging rate exceeds 25% of the Ampere-hour rating of the battery. The microcontroller (2) signals the panel switch (8) to disconnect the solar panel when this predetermined charging rate is exceeded (in this case 300 mA). During the battery charging cycle, the microcontroller continuously checks the charge rate. This provides a margin of safety to prevent battery overcharging. Overcharging is the predominant reason that sealed lead acid batteries do not achieve their rated life expectancy.

The above description is only one of the preferred embodiments of the Entry Alert Guard. The Entry Alert Guard may accommodate many different applications when appropriately configured. In addition to guarding swimming pool entrances, the Entry Alert Guard can also guard the entrances to any potentially dangerous area.

We claim:

1. An apparatus for monitoring the positional status of a moveable barrier in an entryway and capable of providing an audible message when that status is altered comprising:

a) a positional status sensor for monitoring the position of the moveable barrier and outputting either an open or a closed signal;

b) a control circuit connected to said positional status sensor for receiving either the open or the closed signal, said control circuit further comprising a timer, said timer for measuring the time elapsed after the open signal is received, said control circuit for sequentially outputting alert signals at time spaced intervals when the elapsed time exceeds a predetermined time delay and terminating the output of the alert signals when the closed signal is received;

c) a voice synthesizer connected to said control circuit, said voice synthesizer for receiving and matching the alert signal to a message signal and outputting the message signal, d) an audio amplifier, said audio amplifier connected to said voice synthesizer, said audio amplifier for receiving the message signal and outputting an amplified message signal; and e) a speaker, said speaker connected to said audio amplifier, said speaker for receiving and converting the amplified message signal to an audible message.

2. An improved apparatus of claim 1 wherein the positional status switch comprises:

a) a magnetic housing mounted on the moveable barrier, said magnetic housing further comprising an internal magnet; and b) a switch housing mounted on the entryway, said switch housing further comprising a switch, said switch responsive to said internal magnet when mounted in close proximity and in responsive range of said switch;

whereby said magnetic element may open or close said switch, and thereby indicate the positional status of the moveable barrier.

3. An improved apparatus of claim 1 further comprising:

a) a solar panel to receive and convert light to create a charging current;

b) a step-down voltage regulator, said step-down voltage regulator connected to said control circuit and said voice synthesizer;

c) a means for connecting said solar panel to a rechargeable power source to receive said charging current; and d) a means for connecting the rechargeable power source to said step-down voltage regulator and to said audio amplifier.

4. An improved apparatus of claim 1 wherein the control circuit is a microcontroller and the voice synthesis means is an integrated circuit.

5. An improved apparatus of claim 3 further comprising:

a) a mast;

b) an electrical enclosure, said electrical enclosure enclosing said control circuit, said voice synthesizer, said audio amplifier, said step down voltage regulator, and said rechargeable power source, said electrical enclosure rigidly affixed to said mast;

c) said solar panel mounted to said mast; and d) said speaker affixed to said mast;

whereby said solar panel, speaker, and said electrical enclosure may be remotely located.

6. An improved apparatus of claim 3 further comprising:

a) an electronic switch connected to said control circuit, said electronic switch for disconnecting said means for connecting said solar panel to a rechargeable power source;

b) a means for measuring the voltage of said rechargeable power source and charging current from said solar panel, and providing these measurements to said control circuit; and c) a means for said control circuit to evaluate the rechargeable power source voltage and charging current measurements to determine when overcharging is occurring and signaling said electronic switch to disconnect said means for connecting said solar panel to a rechargeable power source;

whereby the electronic switch controls the charging of the rechargeable power source by connecting or disconnecting the solar panel from the rechargeable power source.

7. An apparatus for monitoring the positional status of a moveable barrier in an entryway and capable of providing an audible message when that status is altered comprising:

a) a positional status sensor for monitoring the position of the moveable barrier and outputting either an open or a closed signal;

b) a control circuit connected to said positional status sensor for receiving either the open or the closed signal, said control circuit further comprising a timer, said timer for measuring the time elapsed after the open signal is received, said control circuit for sequentially outputting alert signals at time spaced intervals when the elapsed time exceeds a predetermined time delay and terminating the output of the alert signals when the closed signal is received, and subsequently outputting a stand down signal;

c) a voice synthesizer connected to said control circuit, said voice synthesizer for receiving and matching the alert signal or the stand down signal to a predetermined message signal and outputting the message signal;

d) an audio amplifier, said audio amplifier connected to said voice synthesizer, said audio amplifier for receiving the message signal and outputting an amplified message signal, and e) a speaker, said speaker connected to said audio amplifier, said speaker for receiving and converting the amplified message signal to an audible message.

8. An improved apparatus of claim 7 further comprising:

a) a solar panel to receive and convert light to create a charging current, b) a step-down voltage regulator, said step-down voltage regulator connected to said control circuit and said voice synthesizer, c) a means for connecting said solar panel to a rechargeable power source to receive said charging current, and d) a means for connecting the rechargeable power source to said step-down voltage regulator and to said audio amplifier.

9. An apparatus for monitoring the positional status of a moveable barrier in an entryway and capable of providing an audible message when that status is altered comprising:

a) a positional status sensor for monitoring the position of the moveable barrier and outputting either an open or a closed signal;

b) a control circuit connected to said positional status sensor for receiving either the open or closed signal, said control circuit further comprising a timer for measuring the time elapsed after the open signal is received;

c) a means for said control circuit to sequentially output a plurality of time spaced alert signals when the elapsed time exceeds the time delay, and further terminating the output of the alert signal when the closed signal is received;

d) a voice synthesizing means connected to said control circuit for receiving the alert signal and matching the alert signal to a specific message signal and outputting the selected message signal;

e) an audio amplifier, said audio amplifier connected to said voice synthesizing means, for receiving and amplifying the message signal to output an amplified message signal;

f) a speaker to receive the amplified message signal, said speaker for converting the amplified message signal and outputting an audible message;

g) a step-down voltage regulator, said step-down voltage regulator connected to said control circuit and said voice synthesizer; and h) a means for providing power to said step-down voltage regulator and to said audio amplifier.

* * * * *